US007341204B2

(12) United States Patent
Akabane

(10) Patent No.: US 7,341,204 B2
(45) Date of Patent: Mar. 11, 2008

(54) FUEL INJECTION VALVE

(75) Inventor: Akira Akabane, Kakuda (JP)

(73) Assignee: Keihin Corporation, Tokyo (JP)

( * ) Notice: Subject to any disclaimer, the term of this patent is extended or adjusted under 35 U.S.C. 154(b) by 222 days.

(21) Appl. No.: 11/234,380

(22) Filed: Sep. 26, 2005

(65) Prior Publication Data

US 2006/0065763 A1 Mar. 30, 2006

(30) Foreign Application Priority Data

Sep. 27, 2004 (JP) ..... 2004-279700

(51) Int. Cl.
*F02M 47/02* (2006.01)
*F02M 59/00* (2006.01)
*F02M 61/00* (2006.01)
*B05B 1/30* (2006.01)

(52) U.S. Cl. ..... 239/88; 239/89; 239/533.2; 239/533.12; 239/533.14; 239/585.1; 239/585.5

(58) Field of Classification Search ..... 239/88, 239/89, 91, 95, 533.2, 533.11, 533.12, 533.14, 239/585.1–585.5; 251/127, 129.15, 129.21
See application file for complete search history.

(56) References Cited

U.S. PATENT DOCUMENTS 5,755,386 A * 5/1998 Lavan et al. ..... 239/585.4
5,788,161 A * 8/1998 Potz et al. ..... 239/533.13
6,105,884 A * 8/2000 Molnar et al. ..... 239/585.1
6,131,826 A * 10/2000 Teiwes ..... 239/533.11
6,170,763 B1 * 1/2001 Fuchs et al. ..... 239/533.12

(Continued)

FOREIGN PATENT DOCUMENTS

JP 63-154767 U 10/1988

(Continued)

*Primary Examiner*—David D. Hwu
(74) *Attorney, Agent, or Firm*—Arent Fox, LLP.

(57) ABSTRACT

In a fuel injection valve in which a funnel-shaped fuel collecting recess 35 is provided between a valve seat 8 and an outlet hole 7, and a flat fuel diffusion chamber 36 which diffuses a fuel radially outward and guides the fuel to a plurality of fuel injection holes 11 is provided between opposed surfaces of a valve seat member 3 and an injector plate 10, a seating portion 16*a* having a spherical band shape, and a valve tip end portion 16*b* which projects into a cone shape toward a center of the outlet hole 7 from the seating portion 16*a* and leaves its top portion in the outlet hole 7 even at the time of valve opening of a valve body 18 are formed at the valve body 18, a cone angle α of the valve tip end portion 16*b* is set to be larger than a funnel angle β of the fuel collecting recess 35, and an inner peripheral surface 7A of the outlet hole 7 is formed along an inner peripheral side curved surface of a virtual torus T so that the inner peripheral surface is connected to a bottom surface of the fuel collecting recess 35 and a ceiling surface of the fuel diffusion chamber 36. Thus, generation of eddies at the time of reverse of the fuel flow in the outlet hole of the valve seat member is prevented to reduce pressure loss of the fuel, thereby suppressing decrease in the amount of injected fuel, promoting atomization of the injected fuel and stabilizing spray forms.

4 Claims, 3 Drawing Sheets

U.S. PATENT DOCUMENTS

| | | | | |
|---|---|---|---|---|
| 6,616,071 | B2 * | 9/2003 | Kitamura et al. ..... | 239/533.12 |
| 6,779,743 | B2 * | 8/2004 | Kitamura ..... | 239/533.12 |

FOREIGN PATENT DOCUMENTS

| | | | |
|---|---|---|---|
| JP | 2-067459 | A | 3/1990 |
| JP | 9-250423 | A | 2/1997 |
| JP | 9-137764 | A | 5/1997 |
| JP | 10-507507 | A | 7/1998 |
| JP | 10-281041 | A | 10/1998 |
| JP | 2000-97129 | A | 4/2000 |
| JP | 2002-130074 | A | 5/2002 |

* cited by examiner

FUEL INJECTION VALVE

BACKGROUND OF THE INVENTION

1. Field of the Invention

The present invention relates to a fuel injection valve mainly used in a fuel supply system of an internal combustion engine, and particularly to an improvement of a fuel injection valve which comprises a valve seat member which has at one end portion a valve seat and an outlet hole penetrating through a central portion of the valve seat, a valve body which is housed in the valve seat member and operates to open and close the valve seat, and an injector plate which is joined to one end surface of the valve seat member and has a plurality of fuel injection holes disposed to be spaced radially outward from the outlet hole; in which a funnel-shaped fuel collecting recess for collecting a fuel passing through the valve seat and guiding the fuel to the outlet hole is provided between the valve seat and the outlet hole, and a flat fuel diffusion chamber which diffuses radially outward the fuel passing through the outlet hole and guides the fuel to the plurality of fuel injection holes is provided between opposed surfaces of the valve seat member and the injector plate.

2. Description of the Related Art

Such an electromagnetic fuel injection valve is already known as disclosed in, for example, Japanese Patent Application Laid-open No. 2000-97129.

In such a fuel injection valve, at the time of valve opening of the valve body, a fuel passing through the valve seat is guided to the outlet hole by the fuel collecting recess, reverses its flow to the fuel diffusion chamber from the outlet hole, is diffused radially outward and injected through a plurality of fuel injection holes of the injector plate, thereby forming spray forms.

Incidentally, in the conventional fuel injection valve, the inner peripheral surface of the outlet hole has a cylindrical shape, and a right angle or a near-right angle is formed between the bottom surface of the fuel collecting recess and the inner peripheral surface of the outlet hole, and between the inner peripheral surface of the outlet hole and the ceiling surface of the fuel diffusion chamber. Therefore, when the flow of the fuel reverses in the outlet hole, a number of eddies is generated inside the reverse flow, and causes increase in pressure loss of the fuel to decrease the injection amount, inhibition of atomization of the injection fuel from the fuel injection holes, instability of the direction and shape of the spray forms, and the like.

SUMMARY OF THE INVENTION

The present invention has been achieved in view of the above circumstances, and has an object to provide a fuel injection valve which prevents generation of eddies at the time of reverse of a fuel flow in an outlet hole to decrease pressure loss of the fuel, thereby suppressing decrease in the amount of injected fuel, promoting atomization of the injection fuel and stabilizing spray forms.

In order to achieve the above object, according to a first feature of the present invention, there is provided a fuel injection valve which comprises a valve seat member which has at one end portion a valve seat and an outlet hole penetrating through a central portion of the valve seat, a valve body which is housed in the valve seat member and operates to open and close the valve seat, and an injector plate which is joined to one end surface of the valve seat member and has a plurality of fuel injection holes disposed to be spaced radially outward from the outlet hole; and in which a funnel-shaped fuel collecting recess for collecting a fuel passing through the valve seat and guiding the fuel to the outlet hole is provided between the valve seat and the outlet hole, and a flat fuel diffusion chamber which diffuses radially outward the fuel passing through the outlet hole and guides the fuel to the plurality of fuel injection holes is provided between opposed surfaces of the valve seat member and the injector plate, characterized in that a seating portion having a spherical band shape and seated on the valve seat, and a valve tip end portion which projects into a cone shape toward a center of the outlet hole from the seating portion and leaves its top portion in the outlet hole even at the time of valve opening of the valve body are formed in the valve body; that a cone angle of the valve tip end portion is set to be 145° or less and larger than a funnel angle of the fuel collecting recess; and that an inner peripheral surface of the outlet hole is formed along an inner peripheral side curved surface of a virtual torus so that the inner peripheral surface is connected to a bottom surface of the fuel collecting recess and a ceiling surface of the fuel diffusion chamber.

With the first feature of the present invention, a seating portion having a spherical band shape and seated on the valve seat, and a valve tip end portion which projects into a cone shape toward a center of the outlet hole from the seating portion and leaves its top portion in the outlet hole even at the time of valve opening of the valve body are formed in the valve body, and a cone angle of the valve tip end portion is set to be 145° or less and larger than a funnel angle of the fuel collecting recess. Therefore, a dead volume in the fuel collecting recess and the central portion of the outlet hole is reduced by the valve tip end portion in the cone shape of the valve portion; collecting and guiding the fuel from the fuel collecting recess to the outlet hole can be promoted by exhibiting the rectifying effect to the fuel flow at the time of valve opening of the valve body; and pressure loss of the fuel in the fuel collecting recess can be reduced.

The inner peripheral surface of the outlet hole is formed along an inner peripheral side curved surface of a virtual torus so that the inner peripheral surface connects to a bottom surface of the fuel collecting recess and a ceiling surface of the fuel diffusion chamber. Therefore, reverse of the flow of the fuel in the outlet hole is guided remarkably smoothly by the inner peripheral surface, and generation of eddies inside the flow can be prevented, thus reducing pressure loss of the fuel in the outlet hole.

Since the pressure loss of the fuel in the fuel collecting recess and the outlet hole can be effectively reduced, promotion of atomization of the fuel and stabilization of spray forms can be achieved without decreasing the fuel injection amount from each fuel injection hole of the injector plate, which can contribute to improvement of fuel consumption and output performance of the engine.

According to a second feature of the present invention, in addition to the first feature, the virtual torus is set so that a center of its circular generating line is located on a bisector of an angle formed by the bottom surface of the fuel collecting recess and the ceiling surface of the fuel diffusion chamber.

With the second feature of the present invention, the virtual torus is set so that the center of its circular generating line is located on the bisector of the angle formed by the bottom surface of the funnel-shaped fuel collecting recess and the ceiling surface of the fuel diffusion chamber, the joints of the bottom surface of the fuel collecting recess, the ceiling surface of the fuel diffusion chamber and the inner peripheral surface of the outlet hole can be made smooth, reverse of the flow of the fuel in the outlet port is made more smooth, and generation of eddies at inside the flow can be reliably prevented.

According to a third feature of the present invention, in addition to the first or second feature, a height of the fuel diffusion chamber is set to be ½ or less of a radius of the circular generating line of the virtual torus.

With the third feature of the present invention, the height of the fuel diffusion chamber is set to be ½ or less of the radius of the circular generating line of the virtual torus, whereby the diffusion speed of the fuel in the fuel diffusion chamber is enhanced, detachment of the fuel at the open end of each fuel injection hole is promoted, and atomization of the injection fuel can be effectively achieved. Also, after the fuel injection, the residual fuel can be reliably held in the fuel diffusion chamber by capillary phenomenon, and fuel drop from the fuel injection hole is prevented, which can contribute to reduction in emission.

According to a fourth feature of the present invention, in addition to any of the first to third features, the inner peripheral surface of the outlet hole is constructed by connecting a plurality of conical surfaces which have different cone angles and which are in contact with the inner peripheral side curved surface of the virtual torus or by connecting the plurality of conical surfaces which have different cone angles and a cylindrical surface which is located between the plurality of conical surfaces.

With the fourth feature of the present invention, the inner peripheral surface of the outlet hole is constructed by connecting a plurality of conical surfaces which have different cone angles and which are in contact in the inner peripheral side curved surface of the virtual torus, or by connecting the plurality of conical surfaces which have different cone angles and the cylindrical surface which is located therebetween. Therefore, the inner peripheral surface along the inner peripheral side curved surface of the virtual torus can be machined comparatively easily by cutting or the like.

The above-mentioned object, other objects, features and advantages of the present invention will become apparent from a preferred embodiment, which will be described in detail below by reference to the attached drawings.

DESCRIPTION OF THE PREFERRED EMBODIMENT

A preferred embodiment of the present invention will be described based on the attached drawings.

Figure 1:
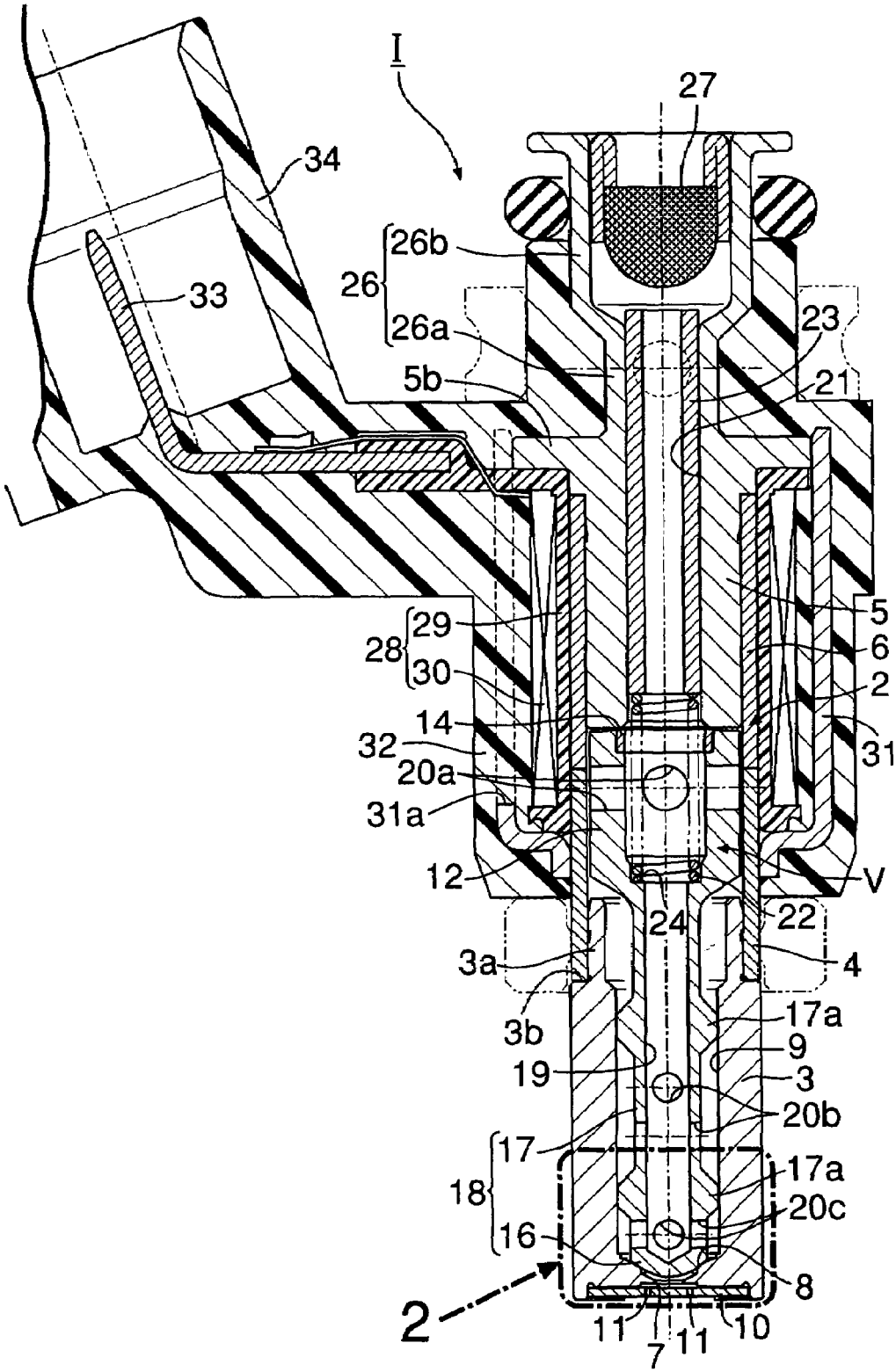
FIG. 1 is a longitudinal sectional view of an electromagnetic fuel injection valve for an internal combustion engine according to an embodiment of the present invention.
Figure 2:
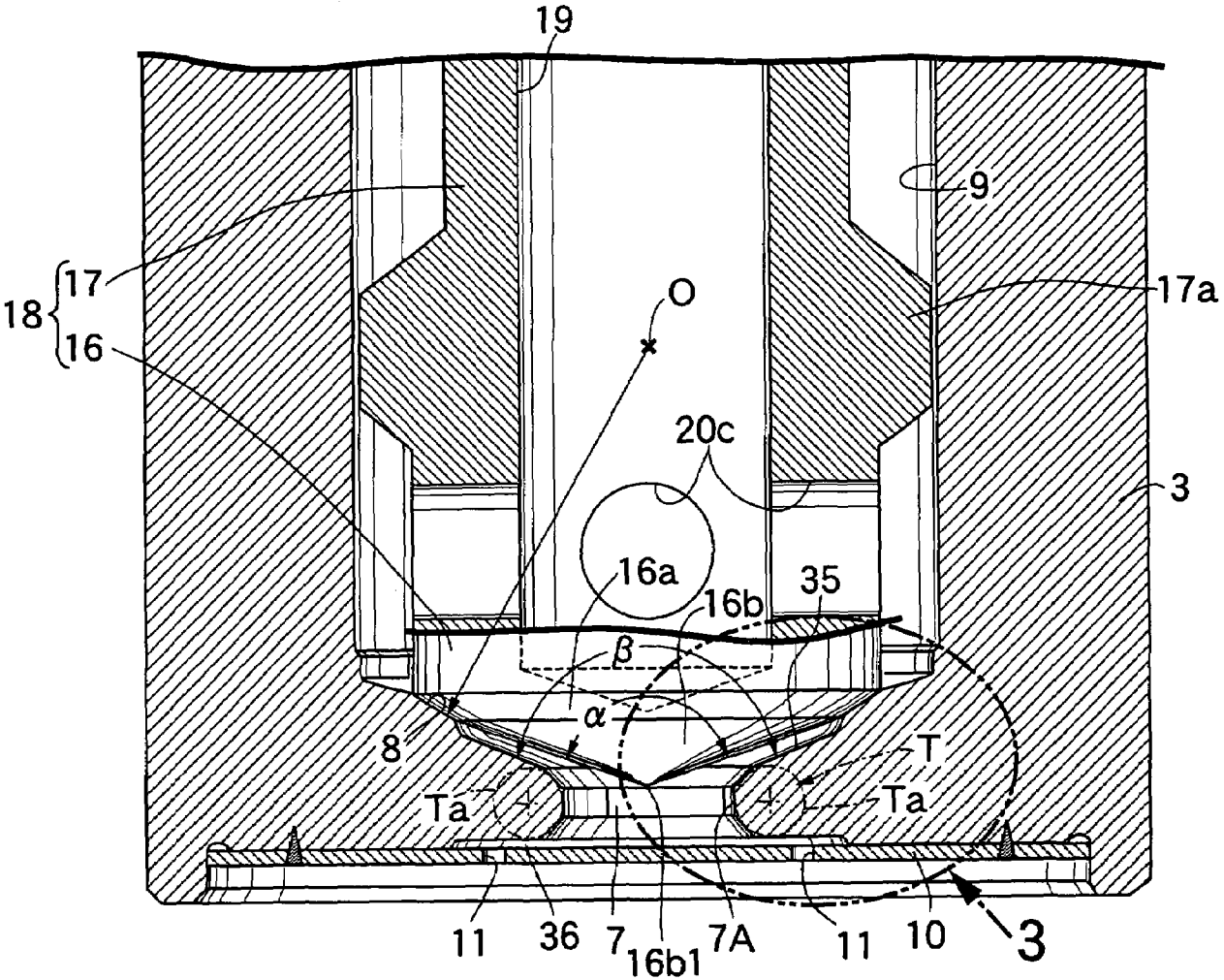
FIG. 2 is an enlarged view of Part 2 in FIG. 1.

First, in FIGS. 1 and 2, a valve housing 2 of an electromagnetic fuel injection valve I for an internal combustion engine comprises: a cylindrical valve seat member 3 having a valve seat 8 at a front end; a magnetic cylindrical body 4 coaxially connected to a rear end portion of the valve seat member 3; and an on-magnetic cylindrical body 6 coaxially connected to a rear end of the magnetic cylindrical body 4.

The valve seat member 3 has at a rear end portion a connecting cylindrical portion 3*a* which projects toward the magnetic cylindrical body 4, and an annular shoulder portion 3*b* extending from its outer peripheral surface. The valve seat member 3 and the magnetic cylindrical body 4 are liquid-tightly and coaxially connected to each other by press-fitting the connecting cylindrical portion 3*a* to a front end portion inner peripheral surface of the magnetic cylindrical body 4, thereby causing a front end surface of the magnetic cylindrical body 4 to abut on the annular shoulder portion 3*b*. The magnetic cylindrical body 4 and the non-magnetic cylindrical body 6 are liquid-tightly and coaxially connected to each other by causing their opposed end surfaces to abut against each other and performing laser beam welding over the entire circumference.

The valve seat member 3 includes a cylindrical guide hole 9, the conical valve seat 8 connecting a front end of the guide hole 9, and an outlet hole 7 penetrating through a central portion of the valve seat 8. An injector plate 10 of a steel plate having a plurality of fuel injection holes 11 which communicate with the outlet hole 7 is liquid-tightly welded over the entire circumference of a front end surface of the valve seat member 3.

A hollow cylindrical fixed core 5 is liquid-tightly press-fitted and fixed to an inner peripheral surface of the non-magnetic cylindrical body 6 from its rear end side. In this process, a portion which is not fitted to the core 5 is left at a front end portion of the non-magnetic cylindrical body 6, and a valve assembly V is housed in a valve housing 2 from that portion to the valve seat member 3.

The valve assembly V comprises: a valve body 18 including a valve portion 16 which operates to open and close the valve seat 8 and a valve rod portion 17 which supports the valve portion 16; and a movable core 12 which is connected to the valve rod portion 17 and which passes through and extends over the magnetic cylindrical body 4 and the non-magnetic cylindrical body 6 so as to be axially opposed to the fixed core 5. The valve rod portion 17 is formed to have a diameter smaller than that of the guide hole 9, and a pair of front and rear journal portions 17*a* and 17*a* which project radially outward and are slidably supported at an inner peripheral surface of the guide hole 9 are integrally formed on an outer periphery of the valve rod portion 17. In this arrangement, both the journal portions 17*a* and 17*a* are disposed so that a space therebetween in an axial direction is provided as large as possible.

The valve assembly V comprises: a vertical hole 19 which extends from a rear end surface of the movable core 12 and ends just before the valve portion 16; a plurality of first lateral holes 20*a* which allow the vertical hole 19 to communicate with an outer peripheral surface of the movable core 12; a plurality of second lateral holes 20*b* which allow the vertical hole 19 to communicate with an outer peripheral surface of the valve rod portion 17 between both the journal portions 17*a* and 17*a*; and a plurality of third lateral holes 20*c* which allow the vertical hole 19 to communicate with an outer peripheral surface of the valve portion 16. In this arrangement, an annular spring seat 24 facing the fixed core 5 is formed at an intermediate portion of the vertical hole 19.

The fixed core 5 has a vertical hole 21 which communicates with the vertical hole 19 of the movable core 12, and a fuel inlet cylinder 26 of which inner portion communicates with the vertical hole 21 is integrally connected to a rear end of the fixed core 5. The fuel inlet cylinder 26 comprises: a reduced diameter portion 26*a* connected to the rear end of the fixed core 5; and an enlarged diameter portion 26*b* connected to the reduced diameter portion 26*a*. A valve spring 22 biasing the movable core 12 toward a valve opening of the valve body 18 is provided under compression between the spring seat 24 and a pipe-shaped retainer 23 which is fitted into and fixed by crimping to the vertical hole 21 from the reduced diameter portion 26*a*. In this arrangement, a set load of the valve spring 22 is adjusted in accordance with the fitted depth of the retainer 23 into the vertical hole 21, and after the adjustment, the retainer 23 is fixed to the reduced diameter portion 26*a* by partially crimping inward the outer peripheral wall of the reduced diameter portion 26*a*. A fuel filter 27 is fitted in the enlarged diameter portion 26*b*.

The fixed core 5 is made of a high-hardness magnetic material of ferrite. On the other hand, in the movable core 12, a collar-shaped stopper element 14 surrounding the valve spring 22 is embedded in an attraction surface facing an attraction surface of the fixed core 5. The stopper element 14 has an outer end projecting slightly from the attraction surface of the movable core 12, and is generally opposed to the attraction surface of the fixed core 5 with a gap corresponding to the valve opening stroke of the valve body 18 being left.

A coil assembly 28 is fitted on the outer periphery of the valve housing 2 corresponding to the fixed core 5 and the movable core 12. The coil assembly 28 is constituted of a bobbin 29 which is fitted onto outer peripheral surfaces of the magnetic cylindrical body 4 and the non-magnetic cylindrical body 6 from the rear end portion of the magnetic cylindrical body 4 to the entire non-magnetic cylindrical body 6, and a coil 30 which is wound around the bobbin 29. A front end of a coil housing 31 surrounding the coil assembly 28 is welded to the outer peripheral surface of the magnetic cylindrical body 4, and a rear end of the coil housing 31 is welded on an outer peripheral surface of a yoke 5*b* which projects into a flange shape from an outer periphery of the rear end portion of the fixed core 5. The core housing 31 is formed into a cylindrical shape, and has a slit 31*a* extending in the axial direction formed at one side.

The coil housing 31, the coil assembly 28, the fixed core 5 and a front half of the fuel inlet cylinder 26 are embedded and sealed in a covering body 32 made of a synthetic resin by injection molding. In this arrangement, charge of the covering body 32 into the coil housing 31 is performed through the slit 31*a*. A coupler 34 which houses a connecting terminal 33 connected to the coil 30 is integrally connected to an intermediate portion of the covering body 32.

Figure 3:
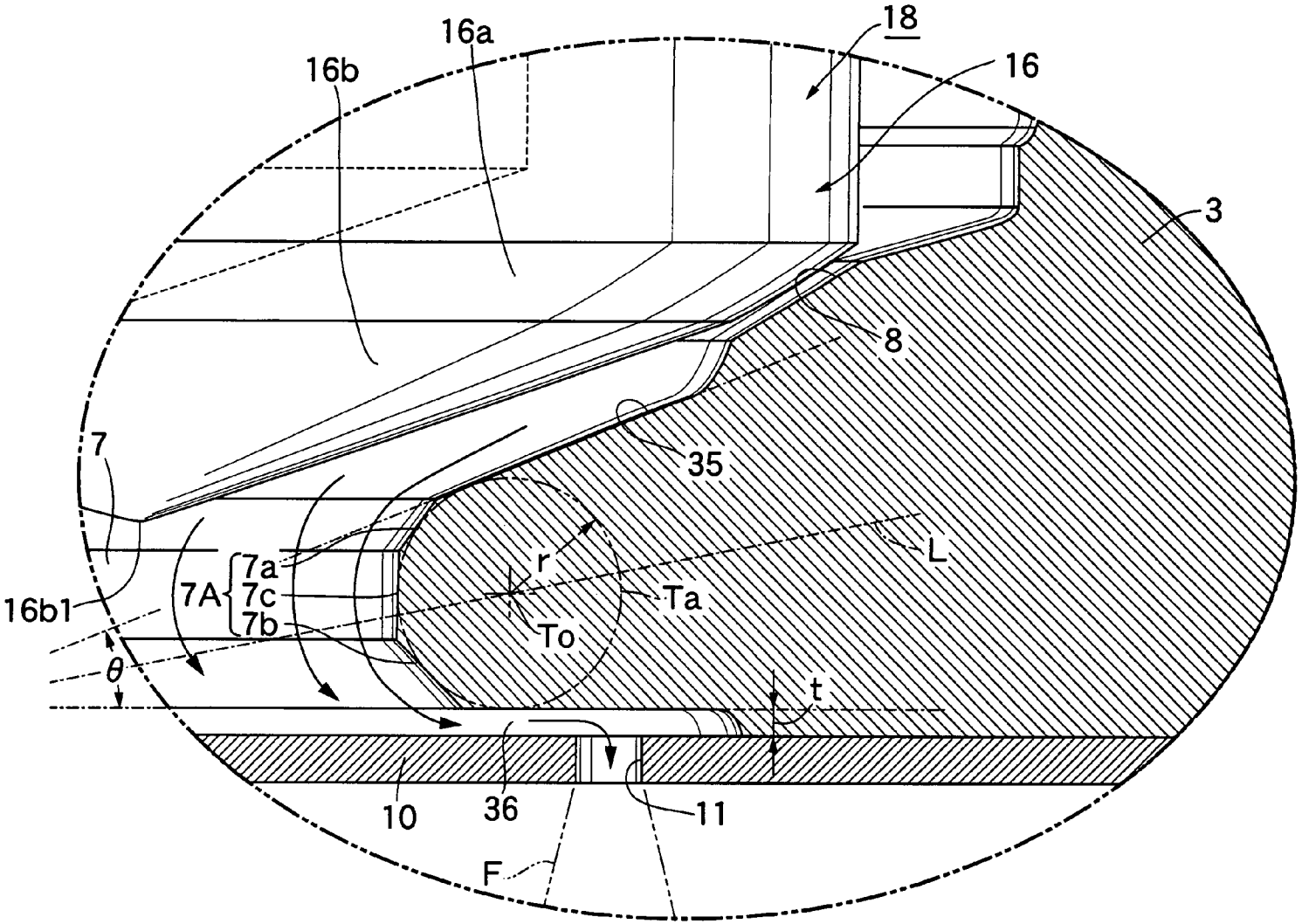
FIG. 3 is an enlarged view showing Part 3 in FIG. 2 in a valve open state.

Referring to FIGS. 2 and 3, a structure including the valve seat 8, the valve portion 16 and their periphery will be described in detail.

The valve seat 8 of the valve seat member 3 is formed into a conical shape. A funnel-shaped fuel collecting recess 35 which collects a fuel passing through the valve seat 8 and guides the fuel to the outlet hole 7 is formed between the valve seat 8 and the outlet hole 7.

Formed on the valve portion 16 of the valve body 18 are a seating portion 16*a* having a spherical band shape and seated on the valve seat 8, and a valve tip end portion 16*b* which projects into a conical shape toward a center of the outlet hole 7 from the seating portion 16*a* and which has a top portion $\mathbf{16}b_1$ left in the outlet hole 7 even at the time of valve opening of the valve body 18. In this arrangement, a cone angle $\alpha$ of the valve tip end portion 16*b* is set to be larger than a funnel angle $\beta$ of the fuel collecting recess 35, and set at 145° or less. The seating portion 16*a* having the spherical band shape has a center on the axis of the valve body 18.

A flat fuel diffusion chamber 36 which extends radially outward from the outlet hole 7 and diffuses radially outward a fuel which has passed through the outlet hole 7, is formed between the opposed surfaces of the valve seat member 3 and the injector plate 10. The fuel diffusion chamber 36 is formed as a recess on a front end surface of the valve seat member 3 in the illustrated example. The injector plate 10 is provided with a plurality of fuel injection holes 11, 11, which opens into the fuel diffusion chamber 36 at a position spaced radially outward from the outlet hole 7. Accordingly, the outlet hole 7 and each of the fuel injection holes 11 communicate with each other via the fuel diffusion chamber 36.

Further, an inner peripheral surface 7A of the outlet hole 7 is formed along an inner peripheral side curved surface of a virtual torus T so as to connect to a bottom surface of the fuel collecting recess 35 and a ceiling surface of the fuel diffusion chamber 36. Specifically, the virtual torus T is set so that a center To of its circular generating line Ta is located on a bisector L of an angle formed by the bottom surface of the funnel-shaped fuel collecting recess 35 and the ceiling surface of the fuel diffusion chamber 36. The inner peripheral surface 7A of the outlet hole 7 is constructed by connecting a plurality of conical surface 7*a* and 7*b* having different cone angles and in contact with the inner peripheral side curbed surface of the virtual torus T, or by connecting the plurality of conical surfaces 7*a* and 7*b* having different cone angles and a cylindrical surface 7*c* located in an intermediate portion therebetween.

A height $\underline{t}$ of the fuel diffusion chamber 36 is set to be ½ or less of a radius $\underline{r}$ of the circular generating line Ta of the virtual torus T, and is preferably set to be t=20 to 110 μm.

Next, the operation of the embodiment will be described.

As shown in FIGS. 1 and 2, in the state in which the coil 30 is demagnetized, the valve assembly V is pressed forward by the biasing force of the valve spring 22 to cause the valve body 18 to be seated on the valve seat 8. Accordingly, the fuel, which is transferred from a fuel pump (not shown) to the fuel inlet cylinder 26, passes through the inside of the pipe-shaped retainer 23, the vertical hole 19 of the valve assembly V and the first to third lateral holes 20*a* to 20*c*; is kept waiting in the valve seat member 3; and is made available for lubrication of the peripheries of the journal portions 17*a* and 17*a* of the valve body 18.

When the coil 30 is magnetized by energization, the thus-generated magnetic flux runs sequentially through the fixed core 5, the coil housing 31, the magnetic cylindrical body 4 and the movable core 12. By this magnetic flux, the movable core 12 of the valve assembly V is attracted by the fixed core 5 against the set load of the valve spring 22, so that the valve portion 16 of the valve body 18 separates from the valve seat 8 of the valve seat member 3 as shown in FIG. 3. Therefore, the high-pressure fuel in the valve seat member 3 passes through the valve seat 8 and is collected by the fuel collecting recess 35 and guided to the outlet hole 7; reverses its flow in the outlet hole 7; moves into the fuel diffusion chamber 36; is diffused radially outward and injected through a plurality of fuel injection holes 11, 11 of the injector plate 10, thereby forming a plurality of spray forms F, F.

Incidentally, the seating portion having the spherical band shape and seated on the valve seat, and the valve tip end portion 16*b* which projects in the conical shape toward the center of the outlet hole from the seating portion 16*a* and leaves its top portion $\mathbf{16}b_1$ in the outlet hole 7 even at the time of valve opening of the valve body 18 are formed at the valve body 18, and the cone angle $\alpha$ of the valve tip end portion 16*b* is set at 145° or less and to be larger than the funnel angle $\beta$ of the fuel collecting recess 35. Therefore, by the conical valve tip end portion 16*b* of the valve portion 16, the dead volume at the central portion of the fuel collecting recess 35 and the outlet hole 7 is reduced, and collection and guidance of the fuel to the outlet hole 7 from the fuel collecting recess 35 can be promoted by exhibiting a rectifying effect to the fuel flow at the time of opening the valve body 18, and reduction in pressure loss of the fuel in the fuel collecting recess 35 can be achieved.

The inner peripheral surface 7A of the outlet hole 7 is formed along the inner peripheral side curved surface of the virtual torus T so that the inner peripheral surface 7A connects to the bottom surface of the fuel collecting recess 35 and the ceiling surface of the fuel diffusion chamber 36. Therefore, reverse of the flow of the fuel in the outlet hole 7 is guided remarkably smoothly by the inner peripheral surface 7A, generation of eddies inside the flow can be prevented, and reduction in pressure loss of the fuel in the outlet hole 7 can be achieved.

Since pressure loss of the fuel in the fuel collecting recess 35 and the outlet hole 7 can be effectively reduced as described above, promotion of atomization of the injection fuel, and stabilization of spray forms can be achieved without decrease in the fuel injection amount from each of the fuel injection holes 11 of the injector plate 10, which contributes to improvement in fuel consumption and output performance of the engine.

The virtual torus T is especially set so that the center To of its circular generating line Ta is located on the bisector L of the angle formed by the bottom surface of the funnel-shaped fuel collecting recess 35 and the ceiling surface of the fuel diffusion chamber 36, the joints of the bottom surface of the fuel collecting recess 35 and the ceiling surface of the fuel diffusion chamber 36 and the inner peripheral surface of the outlet hole 7 can be made smooth, so that generation of eddies inside the flow can be prevented by making reverse of the flow of the fuel in the outlet hole 7 more smooth.

When the inner peripheral surface 7A of the outlet hole 7 is constructed by connecting a plurality of conical surfaces 7*a* and 7*b* which are in contact with the inner peripheral side curved surface of the virtual torus T and have differ cone angles, or by connecting a plurality of conical surfaces 7*a* and 7*b* which differ in cone angle, and the cylindrical surface 7*c* located at an intermediate portion therebetween, the inner peripheral surface 7A of the outlet hole 7 along the inner peripheral side curved surface of the virtual torus T can be comparatively easily machined by cutting or the like.

By setting the height t of the fuel diffusion chamber 36 at ½ or less of the radius r of the circular generating line Ta of the virtual torus T, the diffusion speed of the fuel in the fuel diffusion chamber 36 is enhanced, detachment of the fuel at the open edge of each of the fuel injection holes 11 is promoted, the injection fuel can be effectively atomized, and after fuel injection, the residual fuel can be reliably held in the fuel diffusion chamber 36 by capillarity. Therefore, fuel is prevented from dripping from each of the fuel injection holes 11, which can contribute to reduction in emission. Especially when the height t of the fuel diffusion chamber 36 is set at 20 to 110 μm or less, the dead volume of the fuel diffusion chamber 36 is reduced to enhance the above described effect. When t is 20 μm or less, it is difficult to secure a necessary amount of injection fuel due to increase in flow passage resistance.

The present invention is not limited to the above described embodiment, and various design changes can be made without departing from the subject matter thereof.

What is claimed is:

1. A fuel injection valve which comprises a valve seat member (3) which has at one end portion a valve seat (8) and an outlet hole (7) penetrating through a central portion of the valve seat (8), a valve body (18) which is housed in the valve seat member (3) and operates to open and close the valve seat (8), and an injector plate (10) which is joined to one end surface of the valve seat member (3) and has a plurality of fuel injection holes (11) disposed to be spaced radially outward from the outlet hole (7); and in which a funnel-shaped fuel collecting recess (35) for collecting a fuel passing through the valve seat (8) and guiding the fuel to the outlet hole (7) is provided between the valve seat (8) and the outlet hole (7), and a flat fuel diffusion chamber (36) which diffuses radially outward the fuel passing through the outlet hole (7) and guides the fuel to the plurality of fuel injection holes (11) is provided between opposed surfaces of the valve seat member (3) and the injector plate (10), characterized in that a seating portion (16*a*) having a spherical band shape and seated on the valve seat (8), and a valve tip end portion (16*b*) which projects into a cone shape toward a center of the outlet hole (7) from the seating portion (16*a*) and leaves its top portion ($16b_1$) in the outlet hole (7) even at the time of valve opening of the valve body (18) are formed in the valve body (18); that a cone angle (α) of the valve tip end portion (16*b*) is set to be 145° or less and larger than a funnel angle (β) of the fuel collecting recess (35); and that an inner peripheral surface (7A) of the outlet hole (7) is formed along an inner peripheral side curved surface of a virtual torus (T) so that the inner peripheral surface (7A) is connected to a bottom surface of the fuel collecting recess (35) and a ceiling surface of the fuel diffusion chamber (36).

2. The fuel injection valve according to claim 1, characterized in that the virtual torus (T) is set so that a center (To) of its circular generating line (Ta) is located on a bisector (L) of an angle (θ) formed by the bottom surface of the fuel collecting recess (35) and the ceiling surface of the fuel diffusion chamber (36).

3. The fuel injection valve according to claim 1 or 2, characterized in that a height (t) of the fuel diffusion chamber (36) is set to be ½ or less of a radius (r) of the circular generating line (Ta) of the virtual torus (T).

4. The fuel injection valve according to claim 1 or 2, characterized in that the inner peripheral surface (7A) of the outlet hole (7) is constructed by connecting a plurality of conical surfaces (7*a*, 7*b*) which have different cone angles and which are in contact with the inner peripheral side curved surface of the virtual torus (T) or by connecting the plurality of conical surfaces (7*a*, 7*b*) which have different cone angles and a cylindrical surface (7*c*) which is located between the plurality of conical surfaces (7*a*, 7*b*).

* * * * *